United States Patent [19]

Nelson

[11] 4,117,635

[45] Oct. 3, 1978

[54] EASY CLEAN EAVE TROUGH

[76] Inventor: Vernon L. Nelson, Rte. 2, Box 115, Portland, Oreg. 97231

[21] Appl. No.: 765,289

[22] Filed: Feb. 3, 1977

[51] Int. Cl.[2] ..... E04D 13/06

[52] U.S. Cl. ..... 52/11; 52/16; 405/119

[58] Field of Search ..... 61/15, 28, 14; 52/11, 52/16; 248/48.1, 48.2

[56] References Cited

U.S. PATENT DOCUMENTS

| | | | |
|---|---|---|---|
| 531,989 | 1/1895 | Andrews | 52/16 |
| 2,125,928 | 8/1938 | Knerr | 61/28 |
| 2,624,299 | 1/1953 | Beegle | 52/16 |
| 3,077,055 | 2/1963 | Tripp | 61/15 X |
| 3,091,055 | 5/1963 | Hegedusich | 52/16 |

*Primary Examiner*—Mervin Stein
*Assistant Examiner*—David H. Corbin
*Attorney, Agent, or Firm*—Victor J. Evans & Co.

[57] ABSTRACT

A means for cleaning gutters about the eaves of a house including support means which, when rotated, invert the gutter so that any leaves or other debris will be dumped out, and including remotely operated means to cause dumping of the gutter by rotation of the support means.

6 Claims, 8 Drawing Figures

FIG. 3.
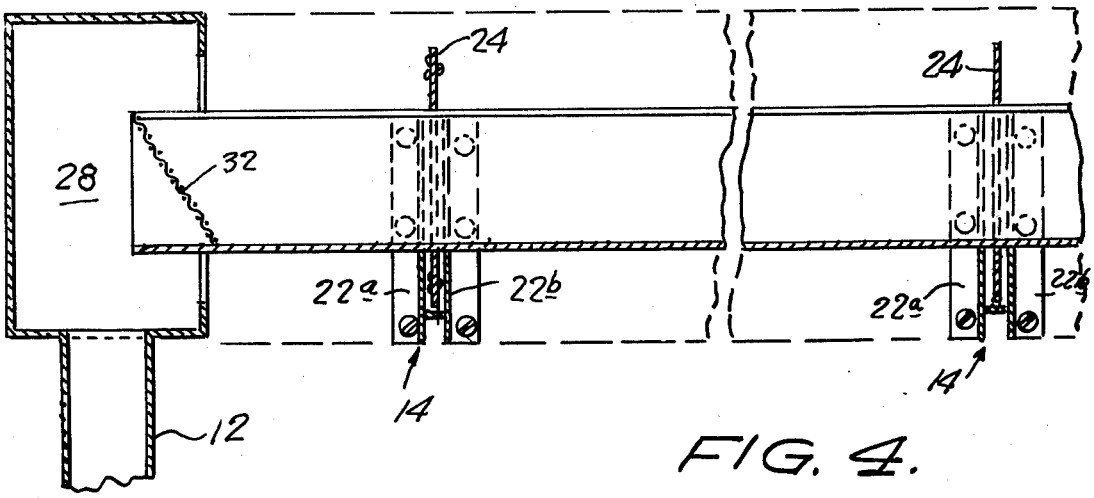
FIG. 4.
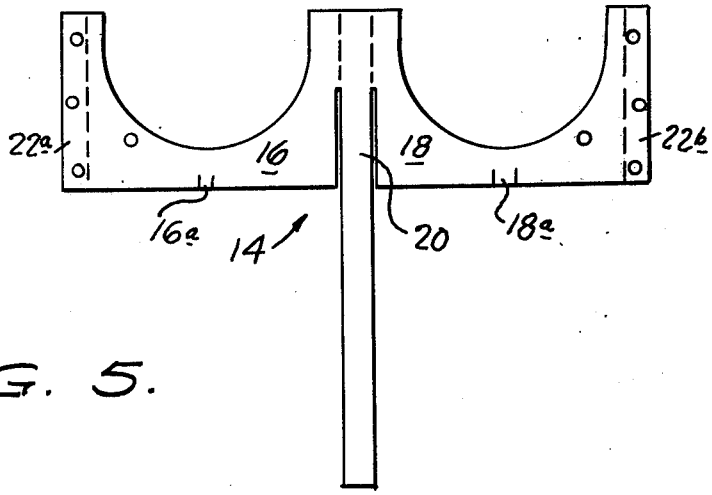
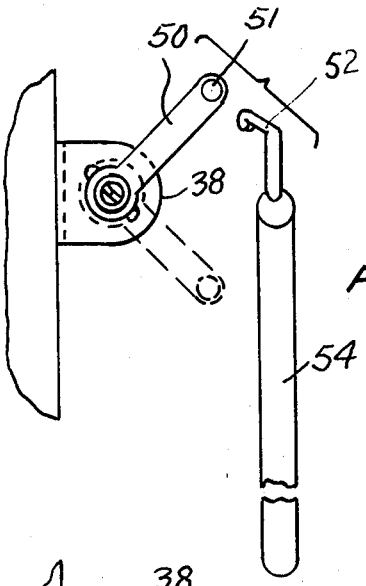
FIG. 5.
FIG. 7.
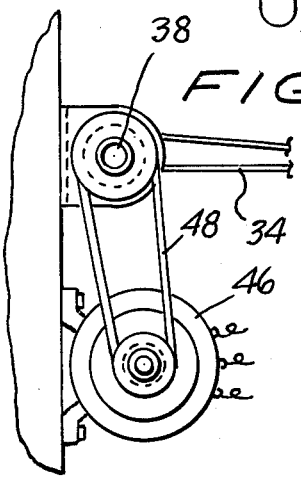
FIG. 6.
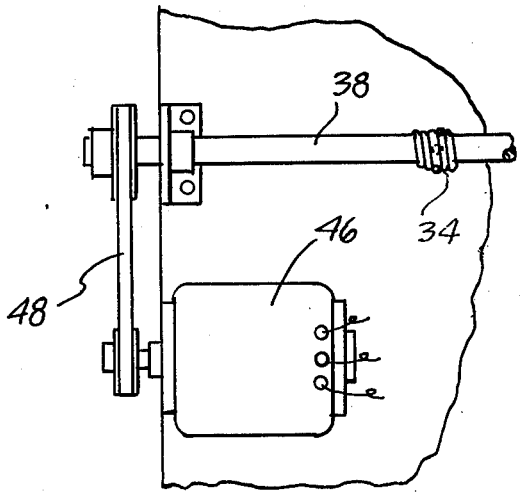

EASY CLEAN EAVE TROUGH

BACKGROUND OF THE INVENTION

Field of the Invention

One recurring problem that faces house-owners is the problem of clogged eave troughs and down spouts that carry water from the roof to the ground.

It is usual to provide a screen in the gutter at the entrance to the down spout where it receives the water from the gutter. While such a screen may prevent debris from entering the down spout it permits the debris to collect against the screen so as to prevent further flow from the eave trough to the down spout. The water will then spill over the edge of the eave trough along its length, the preventing of which is the reason for the eave trough in the first place.

When the debris in the eave trough has accumulated, perhaps not very deeply, along the eave trough, there is the hazard that a rain will float the debris which will then flow toward the down spout and soon clog the screen and the eave trough overflow. To keep the gutters clear of such debris usually requires use of a ladder, or in other cases, involves climbing on roofs, either of which may be hazardous.

It is a principal object of the present invention to provide means such that the eave troughs or gutters of a house may be easily cleared of debris by dumping.

Other and further objects and advantages will appear from the following specification taken with the accompanying drawings in which like reference characters refer to similar parts in the several views.

BRIEF DESCRIPTION OF THE DRAWINGS

FIG. 3 is a section taken on line 3—3 of FIG. 2;

FIG. 4 shows a blank, before being bent, of which one of the support means is formed;

FIG. 5 shows a lever and removeable handle for use in operating the device;

FIGS. 6 and 7 show an end and a side view of a means using an electric motor to operate the device.

DESCRIPTION OF THE PREFERRED EMBODIMENT

Figure 1:
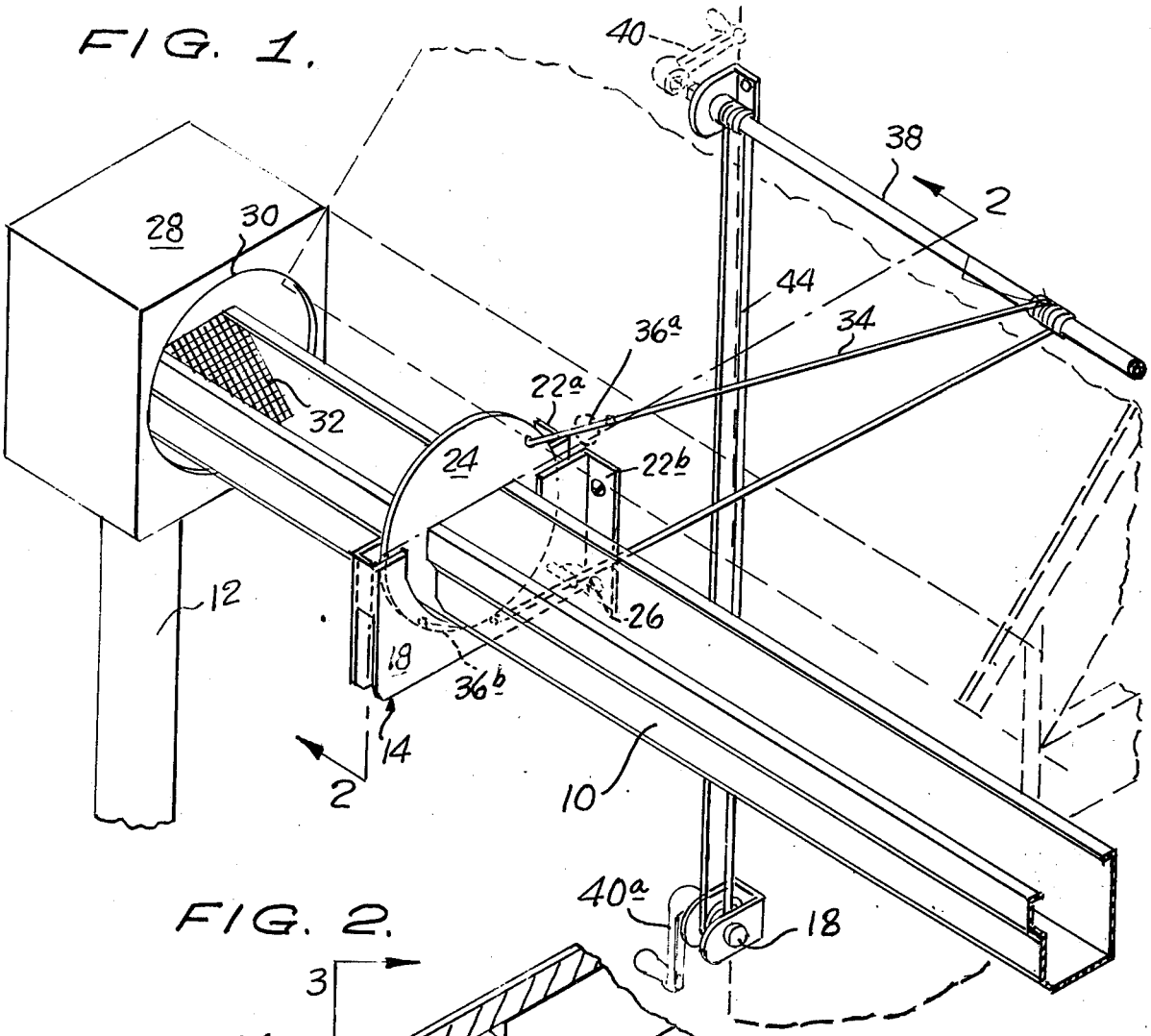
FIG. 1 is a perspective view of one end of an eave trough supported as taught by the present invention and the down spout used therewith, part of the house on which the device is mounted being shown in dotted lines.

In FIG. 1 a standard eave trough or gutter 10 is supported under the edge of the eaves of a house (shown in dotted lines). Such gutters are supported under the edges of the eaves to catch rain water so it will not fall directly to the ground near the foundations which would cause other problems. Such eave troughs also are slightly lower at the end adjacent the down spout 12 than at their other end so that even light rainfalls will be easily drained away from the house foundations. Such eave troughs or gutters are conventionally nailed in place. In the present device, however, as seen in FIG. 3, there are spaced brackets 14 to support gutter element 10 so that it can be rotated about an axis extending longitudinally of the gutter.

Figure 2:
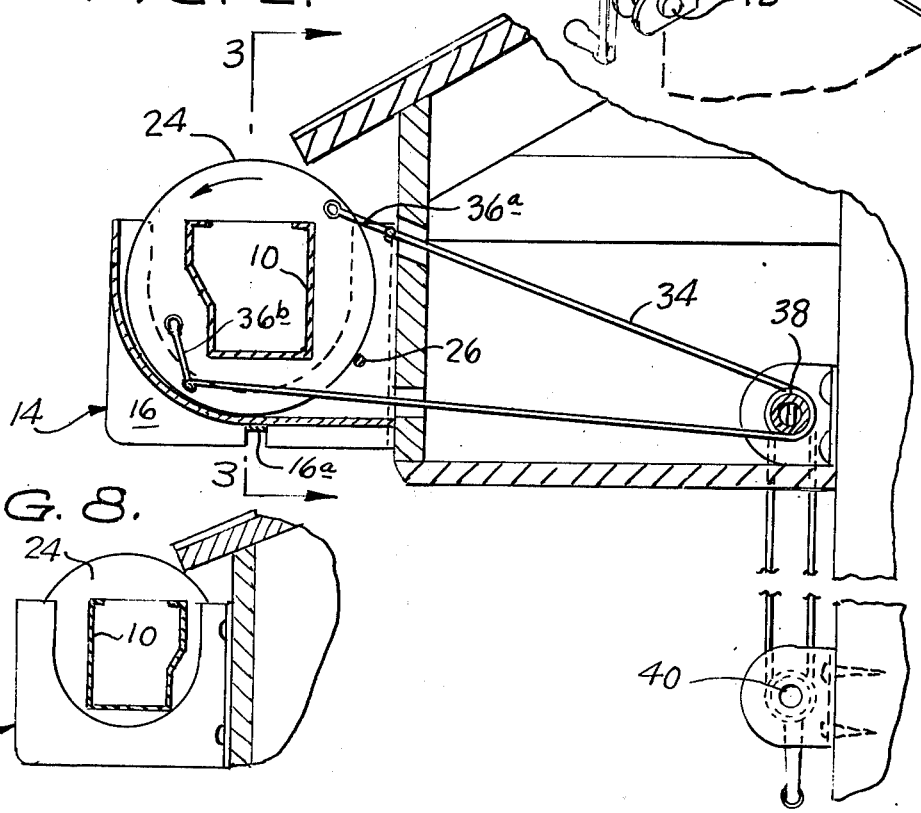
FIG. 2 is a section taken on line 22 of FIG. 1.

A simple form of a bracket 14 is formed from the blank of sheet metal seen in FIG. 4 and comprises two cheek pieces 16 and 18 spaced apart by a narrow strip 20. Each cheek piece has its edge remote from strip 20 bent outwardly to form flanges **22*a* and 22*b* to be secured to the house below the eaves as seen in FIGS. 1, 2 and 3. Strips 20 are elongated beyond the bottoms of cheek pieces 16 and 18 and are curved inwardly toward the house to space the cheek pieces 16 and 18 and to support disc 24. The extension of strips 20 may be supported by tabs such as 16*a* bent inwardly, under strips 20 or may be supported by spot welding strips 20 to cheek pieces 16 and 18**.

The top edges of cheek pieces 16 and 18 are formed with semi-circular notches through which gutter 10 extends and in which gutter 10 is supported.

Figure 8:
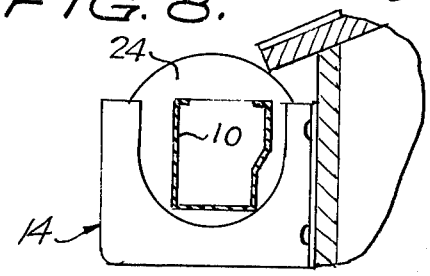
FIG. 8 illustrates that under certain circumstances the eave trough may be reversed.

Gutter 10 is shown as being formed with an outer surface representing an architectural molding, but any shaped gutter may be used; or the gutter 10 may be reversed as seen in FIG. 8 so that it extends further under the drip of the eaves.

Gutter 10 passes through a disc 24 at each bracket 14. Disc 24 is pierced by an aperture shaped to fit the outer contour of gutter 10 and may be but need not be positively secured to gutter 10 by spot welding. In any case rotation of disc 24 causes rotation of gutter 10 about its longitudinal axis.

The center of disc 24 should of course be positioned to approximately coincide with the axis about which gutter 10 is to be rotated which should also be approximately at the center of curvature of the arcuate cut-outs in the top of cheek pieces 16 and 18. More elaborate supports 14 may be devised to rotatably mount gutter 10. Disc 24 is supported by strip 20, and is prevented from moving toward the building on which bracket 14 is mounted by a stud 26 extending between cheek pieces 16 and 18.

A box like element 28 is mounted at the top of down spout 12 into which the gutter extends at one end. Opening 30 in the side of box 28 must be large enough so as not to interfere with the rotation of gutter 10. A screen 32 is provided at the end of gutter 10 at the point where it enters box 28 to retain debris in the gutter so it will be dumped when the gutter is rotated.

Whenever it is desired to dump debris that has accumulated in gutter 10, it is only necessary to rotate gutter 10 about its axis. This may be done as shown in FIGS. 1 and 2 by connecting a flexible element 34 to disc 24 at each of its ends. The ends of flexible element 34 each carry a link **36*a* or 36*b* which are secured at points opposite each other on a diameter of disc 24**.

As seen in FIG. 2 the link **36*b* will contact the edge of disc 24, as the gutter 10 is returned to normal position to catch rain water from the eaves of a building, so that the pull of flexible element 34 will be exerted at the edge of disc 24, not on the direct line from the point at which link 36*b* is secured to disc 24, thus assuring that the pull on disc 24 will have the greatest possible mechanical advantage even though the point at which the link 36*b* is secured to disc 24** passes beyond the lowest point of the disc.

The flight of the flexible element 34 passes several times around a shaft 38 then is secured to the shaft, then passes several times around the shaft in the same direction so that when shaft 38 is rotated it takes up on one side and lets off on the other side equal lengths of flexible element 34. Shaft 38 if turned counter clockwise in FIG. 2, would then, pull on the lower flight of element 34 to trip the gutter over to dump any debris that might have collected; and rotating shaft 38 clockwise will return gutter 10 to its operative position as shown in FIGS. 1, 2 and 3. Shaft 38 will extend as far as required so that each disc 24, at the several supports, will be served to have a flexible element 34 for that support operative to assist in dumping gutter 10.

Shaft 38 may be rotated by a hand-crank 40 at the end of the shaft 38 as seen in dotted lines in FIG. 1, or a stub shaft 42 may be provided at any convenient location to be rotated by a hand-crank 40*a*. Stub shaft 42 is shown as drivingly connected to shaft 38 by a conventional means 44. Any means that will rotate shaft 38 upon rotation of stub shaft 42 may be used.

Other means may be used to rotate shaft 38 such as a reversible electric motor 46 as shown in FIGS. 6 and 7, driving shaft 38 via a belt 48. Suitable reduction gearing is provided between motor 46 and belt 48.

As seen in FIG. 5, shaft 38 may be provided at its end with an arm 50 in lieu of the crank 40 seen in FIG. 1. Such an arm will be provided with a hole 51 at its end to be engaged by a hook 52 mounted on a handle 54. When it is desired to dump the gutter, hook 52 may be inserted in hole 51 by an operator standing on the ground.

Use of arm 50 and hook 52 will be especially useful if mounted directly on gutter 10 at its end remote from box 28, and where the weight (length) of the gutter 10 is short.

Having thus described the preferred embodiment of the invention it should be understood that numerous structural modifications and adaptations may be resorted to without departing from the spirit of the invention.

What is claimed is:

1. Apparatus for cleaning a gutter below the eaves of a building comprising: support means for the gutter on a vertical face of the building, and means to rotate and invert the gutter so as to empty any accumulated debris including at least one disc surrounding said gutter carried on said support means connected to a shaft which is horizontally offset from and parallel to said gutter, said shaft also supported on a vertical face of the building, said disc and said shaft connected by a single flexible element, said flexible element having two terminal portions, one terminal portion of which is connected to a first link which is connected to said disc along the outer periphery of, said other terminal portion also connected to a second link which is connected to the outer periphery of said disc diametrically opposed from said first link, said flexible element having a medial portion which is wound about said shaft and means to rotate said shaft so that when said shaft rotates said disc and the gutter rotates therewith through said flexible element by said flexible element wrapping and unwrapping about said shaft.

2. The apparatus of claim 1 in which said means to support and rotate the gutter includes a pair of parallel U-shaped brackets, each bracket having vertical legs forming the U, in which one vertical leg of each bracket is connected by a strip which extends downwardly and underlies and supports said disc, and the other vertical leg of each bracket terminates in a flange orthogonal to the plane of said U-shaped brackets so as to provide a surface for connecting said flanges to the vertical face of said building.

3. The device of claim 2 in which said means to rotate said shaft include a crank fastened coaxially with said shaft.

4. The device of claim 2 in which said means to rotate said shaft include a crank axially offset from said shaft and connected thereto by a drive belt.

5. The device of claim 2 in which said shaft includes an electric motor axially offset from said shaft and connected thereto by a drive belt.

6. The device of claim 2 in which said shaft includes a lever connected to and extending radially outwardly from said shaft having an opening remote from said shaft to allow a handle having a hook thereon to engage said hole to rotate said shaft.

* * * * *